US005505315A

United States Patent [19]

Carroll

[11] Patent Number: 5,505,315

[45] Date of Patent: Apr. 9, 1996

[54] GRAVITY FEED MERCHANDISING APPARATUS

[75] Inventor: Francis A. Carroll, Dublin, Ireland

[73] Assignee: Carroll Products and Designs Limited, Dublin, Ireland

[21] Appl. No.: 295,835

[22] PCT Filed: Mar. 4, 1993

[86] PCT No.: PCT/IE93/00009

§ 371 Date: Aug. 30, 1994

§ 102(e) Date: Aug. 30, 1994

[87] PCT Pub. No.: WO93/17607

PCT Pub. Date: Sep. 16, 1993

[30] Foreign Application Priority Data

Mar. 4, 1992 [IE] Ireland ..... 920685

[51] Int. Cl.[6] ..... A47F 5/00

[52] U.S. Cl. ..... 211/59.2; 211/51; 211/59.3; 312/71

[58] Field of Search ..... 211/59.2, 59.3, 211/51, 184; 312/71, 42

[56] References Cited

U.S. PATENT DOCUMENTS

| | | | |
|---|---|---|---|
| 1,418,153 | 5/1922 | Lorber | 211/51 X |
| 2,401,409 | 6/1946 | Bloom | 211/51 |
| 4,369,887 | 1/1983 | Emery | 211/51 X |
| 4,565,725 | 1/1986 | Spamer et al. | 211/59.2 X |
| 4,651,883 | 3/1987 | Gullett et al. | 211/59.2 |
| 5,088,607 | 2/1992 | Risafi et al. | 211/59.3 |

*Primary Examiner*—Robert W. Gibson, Jr.
*Attorney, Agent, or Firm*—Hoffmann & Baron

[57] ABSTRACT

A gravity feed merchandising apparatus having a sloped shelf, a vertical front wall and a slidable cassette for pushing merchandise on the shelf towards the front wall. A plurality of dividers divide the shelf into compartments, each one of which is provided with a cassette into which a portion of the merchandise is placed. The combined weight of the cassette and the merchandise contained therein forces the remainder of the merchandise to the front of the shelf adjacent the from wall. The lower edge of the front wall of the cassette has a rim which contacts the merchandise to the front thereof.

9 Claims, 7 Drawing Sheets

GRAVITY FEED MERCHANDISING APPARATUS

The present invention relates to a merchandising apparatus, in particular to a gravity feed merchandising apparatus for use in retail shops and similar outlets where consumer products are on sale to the public.

The invention may be used in the following retail sectors but has general application throughout the retail industry:

Supermarkets/Hypermarkets

Department stores

Convenience stores

Petrol forecourt shops

Symbol groups (an arrangement between differently owned shops trading under a common trade mark)

CTN's (Confectionary/Tobacco/Newsagents)

The invention addresses specific problems relating to prior-art, merchandising apparatus (e.g. modular metal shelving) and particularly in relation to their failure to:

(a) cater adequately for a large variety of modern packaged consumer products.

(b) utilise efficiently the available selling space (known in the industry as "merchandise cube space").

(c) maintain good visual presentation of products throughout the daily selling period irrespective of light or heavy selling patterns.

The invention also reduces the staff time/cost factor in servicing merchandising apparatus by "Merchandisers" whose sole purpose is to "feed" the apparatus or shelves with replacement products and/or re-arrange the products in a visually attractive manner, particularly in heavily shopped outlets like supermarkets, forecourts etc. A very important feature of the invention is its ability to be retrofitted on existing store equipment using the existing modular structures to hang or support the gravity feed merchandising apparatus.

The invention addresses the various merchandising problems/opportunities identified in the retail industry under the following headings:

Prior Art Merchandising Apparatus

Consumer Product Packaging

Product Mix

New Merchandising Technology and Space Management

Traditionally, merchandising fittings and apparatus were provided by bespoke "shopfitters" as part and parcel of shopfitting contracts designed and manufactured specifically to suit the retailer's requirements. Many such shopfitting contractors still exist today and continue to operate in specific retail sectors (e.g. high street fashion outlets etc.) but they are in the minority in the industry as a whole.

The vast majority of merchandising apparatus currently used in the industry are modular constructions, mass produced in-factory and fitted by shop equipment suppliers catering for Department stores, supermarkets, convenience stores, forecourt shops, newsagents, chemists, etc. etc. These apparatus mainly comprise pressed metal shelving apparatus, tubular metal shelving, timber shelving, and, to a lesser extent, glass and acrylic shelving. Pressed metal shelving dominates the market world-wide due to its strength, flexibility and relatively cheap cost. Little difference exists between the hundreds of pressed metal shelving manufactured throughout the world, except for the degree of automation used in their manufacture. Standardisation of module sizes and specification renders the metal shelving industry a truly international business.

Standardisation and automation, however, have certain drawbacks insofar as they inhibit a manufacturer's ability to respond to specific merchandising problems presented by changes in retail design concepts, new product packaging, new retail management demands due to advances in information technology, space management, etc. etc.

Modern shelving equipment, as described previously, is designed to cater for the majority of consumer product shapes and/or packaging. However, a small but increasing number of products are packaged by manufacturers with little thought or consideration for the problems they present to the retailer when it comes to merchandising them on standard shelving equipment. In general terms, any product and/or packaging which is not capable of free standing on its own presents an obvious problem when merchandised on standard shelving equipment insofar as they fall over as soon as the first few products are removed by customers. This is illustrated in FIG. 1A of the accompanying drawings.

This presents the retailer with the problem of constant maintenance by merchandising staff, of these product areas, far in excess of the norm for the rest of the store. Failure to provide extra merchandising maintenance results in loss of sales/profit through poor product presentation and poor accessibility. Some such product manufacturers provide additional support packaging for use on shelves but these are expensive and unsatisfactory (e.g. vacuum formed plastic trays with ribbed bases to support packs). Typical examples of this type of problem packaging are as follows:

Ladies hosiery packs, lingerie, etc.

Powder soup packs, gravy mixes, desserts, etc.

Bagged confectionary and snacks, etc., etc.

The modern Supermarket/Convenience Store provides a diverse mix of consumer products (e.g. health and beauty products) in addition to the grocery products normally associated with these retail sectors. Merchandising small packs, bottles and similar small items on standard shelving systems presents the retailer with a major space management problem with prior art shelving that has no satisfactory solution, i.e. leave adequate space between shelves to allow access to rear of shelf thus losing vertical cube space or reduce space between shelves and thus lose horizontal cube space at back of shelves and/or create dead stock zone. In the latter case, retailers are obliged to use "shelf limiters", placed at the back of shelves to prevent product being lost in "dead stock" zones never to be purchased.

This problem exists also with regular sized products located on lower and base shelves where a customer's visual and physical accessibility is dramatically reduced. Shelf limiters not only waste valuable selling space but also cost money to provide and fit.

Modern bar code technology has enabled retailers to gather accurate information on sales performance of any individual consumer product and consequently, can accurately establish the effects of location, presentation, point of sale, customer accessibility and numerous other factors, on the sales of the product or group of products. This technology also provides accurate information on the most efficient use of selling space and the critical "payback periods" on investments in merchandising equipment. Consequently, the modern retailer is much more conscious of the necessity for better product presentation and management, more efficient use of valuable selling space and less staff merchandising costs in store operations.

U.S. Pat. Nos. 4,369,887, 4,651,883 and 5,088,607 disclose a gravity feed merchandising apparatus comprising a sloped shelf for supporting merchandise, a substantially upstanding front wall and a slidable container for urging or pushing the merchandise towards the front wall, with the container being adapted to contain approximately between 10% and 30% of the merchandise so as to create the force necessary to push the remaining stock of merchandise forward.

The present invention is characterised in that the container is fabricated or moulded in a material with a low co-efficient of friction and is provided with a generally horizontally disposed buffer at the lower edge of the front wall of the container for contact with merchandise adjacent the container, whereby when an item of merchandise is removed from the shelf, the remaining stock of merchandise is advanced towards the front wall under the action of the buffer directing the force of the container at the lower edges of the merchandise Advantageously, the container is substantially of a U-shaped construction, with the front wall of the U being inclined rearwardly to define an edge which acts as the buffer.

Alternatively, the container is substantially of a U-shaped construction having a buffer element provided at the lower edge of the front wall of the U.

Advantageously, the shelf is sloped downwardly from its rear to the front wall and has a sliding surface for the pushing means or container.

Preferably, the upstanding wall at the front of the shelf is set in a vertical plane irrespective of the slope of the shelf.

Conveniently, the shelf is divided longitudinally into a number of compartments by a plurality of parallel adjustable dividers, with each compartment being approximately the width of the respective merchandise and with each compartment having a pushing means or a container for a portion of merchandise.

Advantageously, the adjustable dividers extend substantially the full depth of the shelf for each compartment of merchandise.

Preferably, the dividers are free standing 'L' shaped elements with the horizontal arm of the 'L' providing a suitable surface for the container to slide on.

Conveniently, the dividers are substantially flat strip elements attached to the front wall and/or a back wall by connectors.

The cassette may be of fabricated or injection moulded plastic or similar manufacture in a variety of materials, e.g. acrylic plastics material. In its simplest form it may be a 'U' shaped, preferably in acrylic or similar material with a low co-efficient of surface friction. In its more sophisticated form it may incorporate ribs, roller bearings or slides to reduce friction between the sliding surfaces. The cassette, cross sectional shape is critical to the success of the gravity feeding action. The back must form a vertical wall while the front must either (a) tilt back 10°/15° from the vertical or (b) form a projecting buffer at the base to create a pushing motion to the base of the product. The cassette may also be used to 'flag' a re-order reminder to shop staff when it reaches the front of the shelf. The final quantity of stock contained in the cassette is sold from the cassette itself while awaiting new stock and is maintained in the vertical plane within its narrow walls. The weight, critical centre of gravity and shape of the front face, are important factors in the design of the cassette.

The invention has no mechanical moving parts and can be manufactured in metal, timber, acrylic or any suitable modern material. The trays or shelves can be provided in single or multiple groups designed to connect to existing traditional merchandising equipment (e.g. metal or timber shelving systems) or could be provided as free standing units in single or multiple tray/shelf form, suitable for placing on any flat surface, or base, or floor. The invention's application is universal throughout the shopfitting and retail industries.

The benefits to the retail industry are considerable in terms of space saving, staff time saving and vastly improved product merchandising for problematic consumer product categories.

The benefits to the product manufacturers and distributors are equally significant in terms of cost savings on additional support packaging, reduction in mobile merchandising staff time and increased sales from improved merchandising.

The invention will hereinafter be more particularly described with reference to the accompanying drawings which show, by way of example only one embodiment of a gravity feed merchandising apparatus according to the invention and showing a number of uses of the invention. In the drawings:

FIGS. 1A and 1B are typical sections of prior art merchandising apparatus (tray or shelf) arrangements which clearly illustrates the dead stock zones which occur with a prior art merchandising shelf and also illustrates the problem of merchandising flat or flat packed products on FIG. 2 is a perspective view of a merchandising apparatus according to the invention illustrating a number of compartments formed by a plurality of adjustable dividers and slidable cassette members;

Figure 1A:
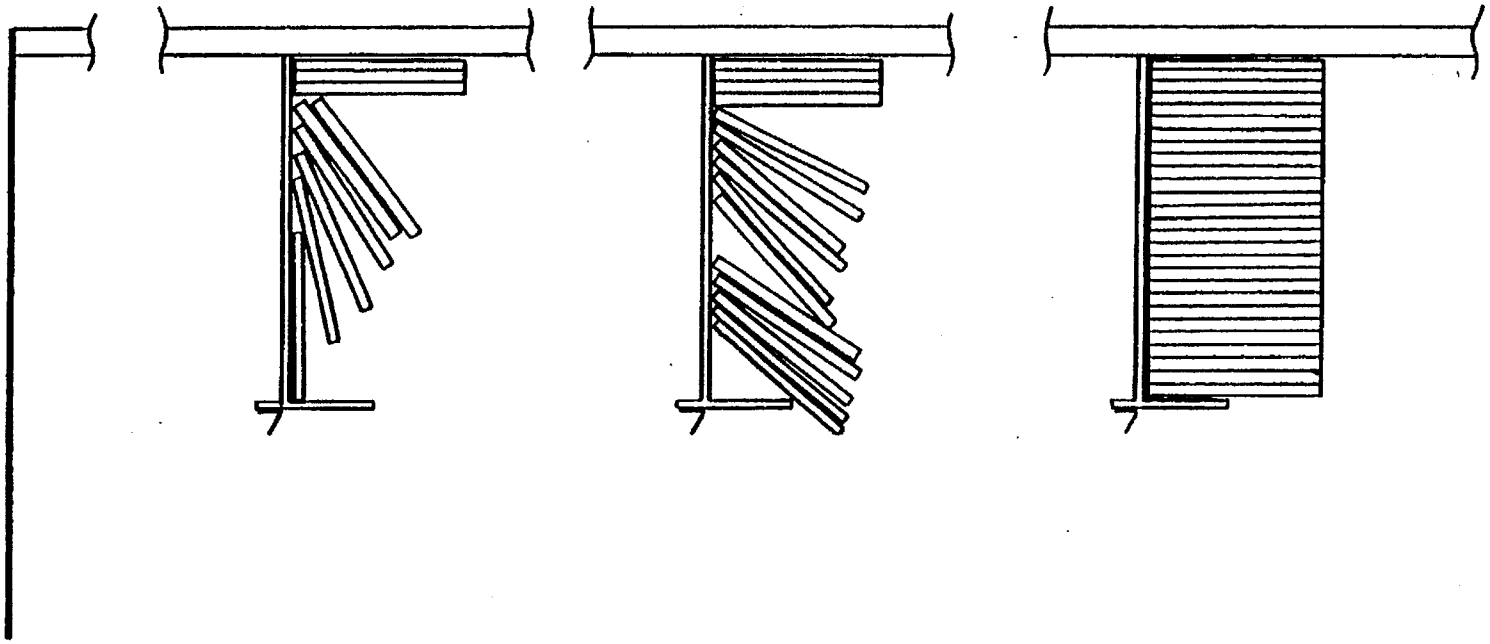
FIG 1a PRIOR ART
Figure 1B:
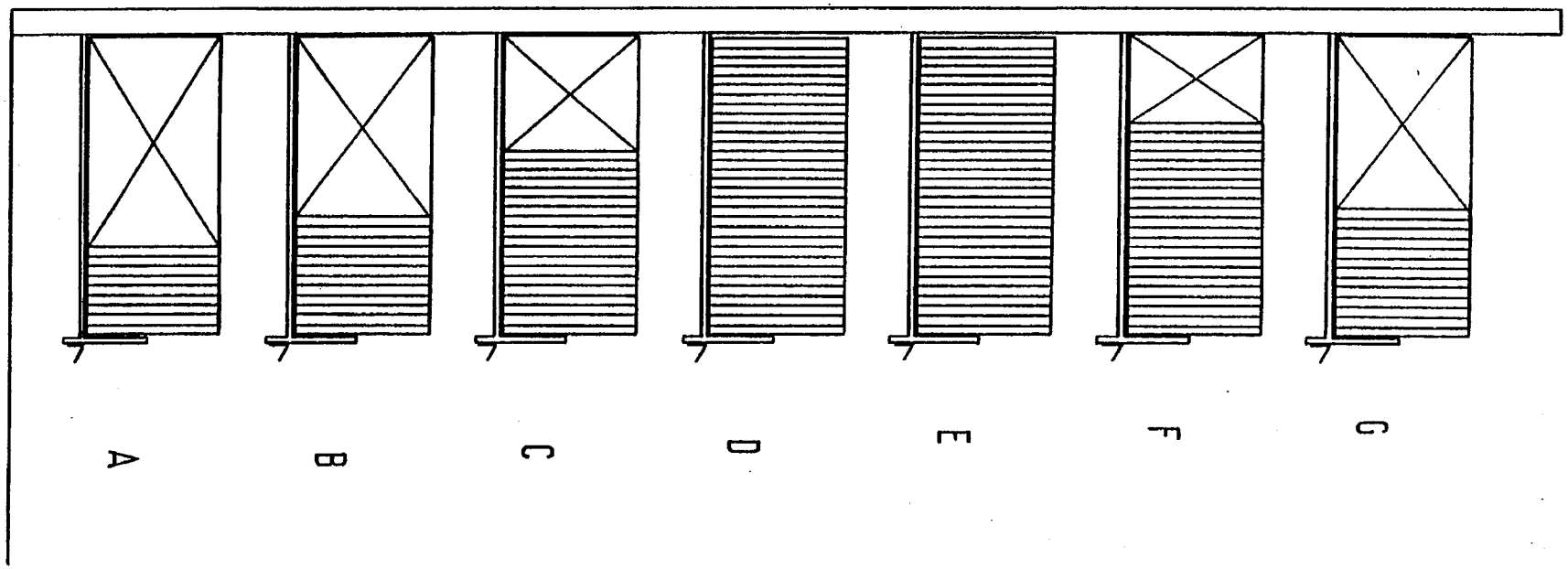
FIG 1b PRIOR ART
Figure 2:
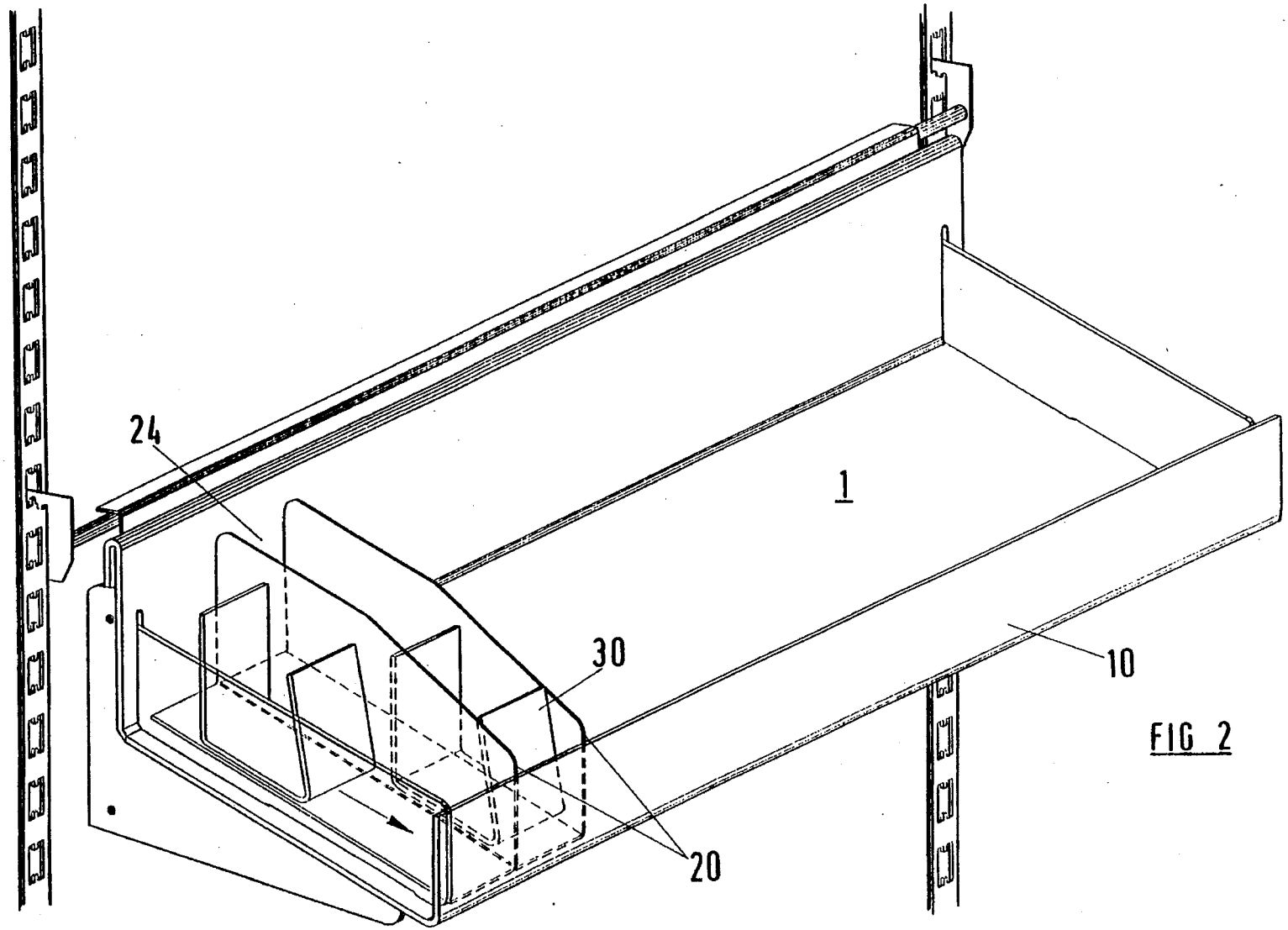
Figure 3:
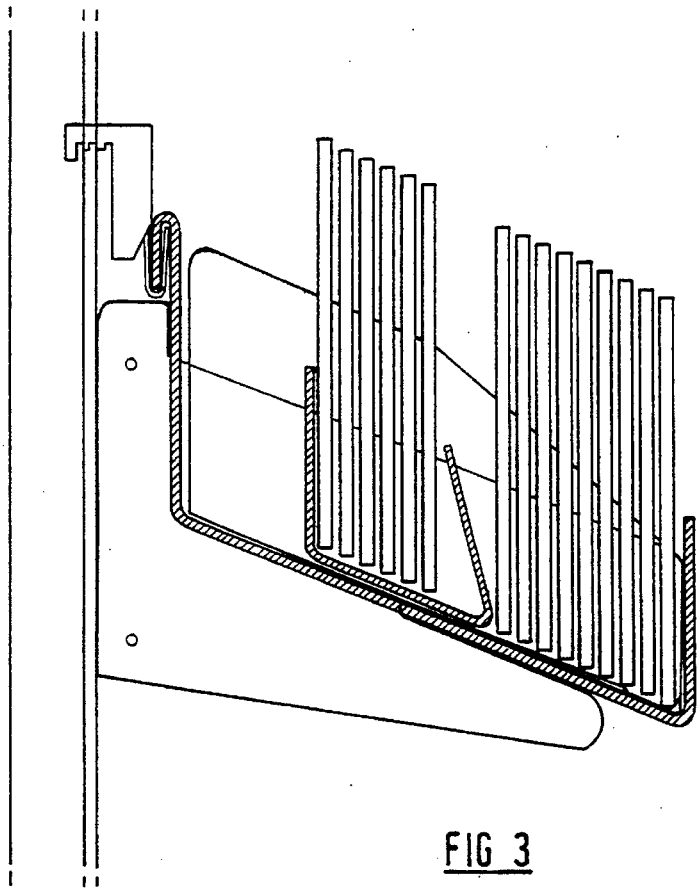
FIG. 3 is a cross-sectional view through a merchandising apparatus according to the invention.

Referring to the drawings and particularly to the prior art merchandising system illustrated in FIG. 1B, it will be seen that the prior art shelving creates dead stock zones at levels A, B, F and G due to their inaccessibility by the consumer. This problem necessitates:

(a) The use of shelf limiters to prevent stock being placed in these zones; or (b) constant servicing of these shelves by merchandising staff to ensure that stock is pulled forward to the front of shelves.

Solution (a) costs extra money in providing shelf limiters and is wasteful of valuable selling space.

Solution (b) is very costly in staff terms and failure to service these areas properly will result in lost sales.

This problem is even more acute when small products are merchandised on prior art merchandising shelf systems. Two options are available to the retailer, (a) extend the space between the shelves to allow access to all the products or (b) put shelf limiters at rear of the shelves.

Referring to FIGS. 2 to 6, the invention comprises a shelf 1 typically at a slope of approximately 25° to the vertical with a glass or acrylic or wire front wall 10 provided on the shelf 1. A plurality of dividers 20 which can be moved relative to one another so as to divide the shelf 1 into a number of compartments 24 for containing merchandise. At the rear of each compartment 24 is a slidable cassette 30 into which a portion (typically 10% to 20%) of merchandise is placed. The combined weight of the cassette 30 and the product or merchandise in the cassette forces the remainder of the merchandise to the front of the shelf 1 and adjacent the front wall 10.

Figure 4A:
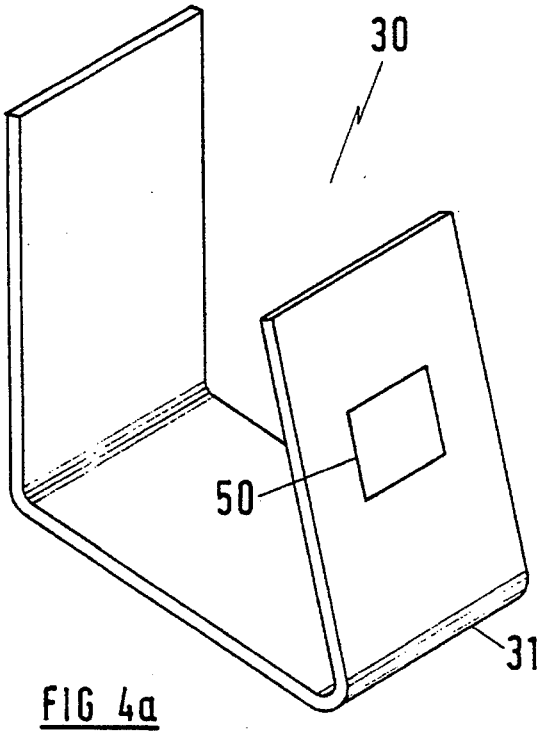
FIG. 4 is a perspective view of a sliding cassette member.

A flag or re-order notice 50 may be provided at the front of the slidable cassette 30 so as to indicate to store personnel that additional product needs to be ordered from stock and placed on the shelf. Ribs 60 can be provided on the underside of the cassettes 30 so as to reduce friction with the dividers 20 if found necessary. A cassette 30 manufactured from suitable flat material can be quite adequate provided the critical cross section profile as indicted in FIG. 4*a* is maintained, with a rim 31 being provided at the lower edge of the front wall of the cassette.

Figure 4B:
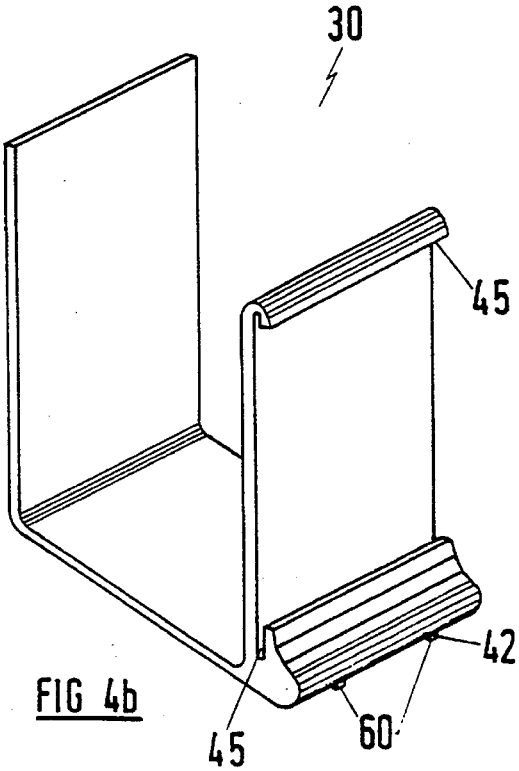

More sophisticated injection moulded or similar manufactured cassettes can be provided incorporating additional features as illustrated in FIG. 4*b* such as a buffer 42 and slots 45 for accommodating a card or ticket.

Figure 6:
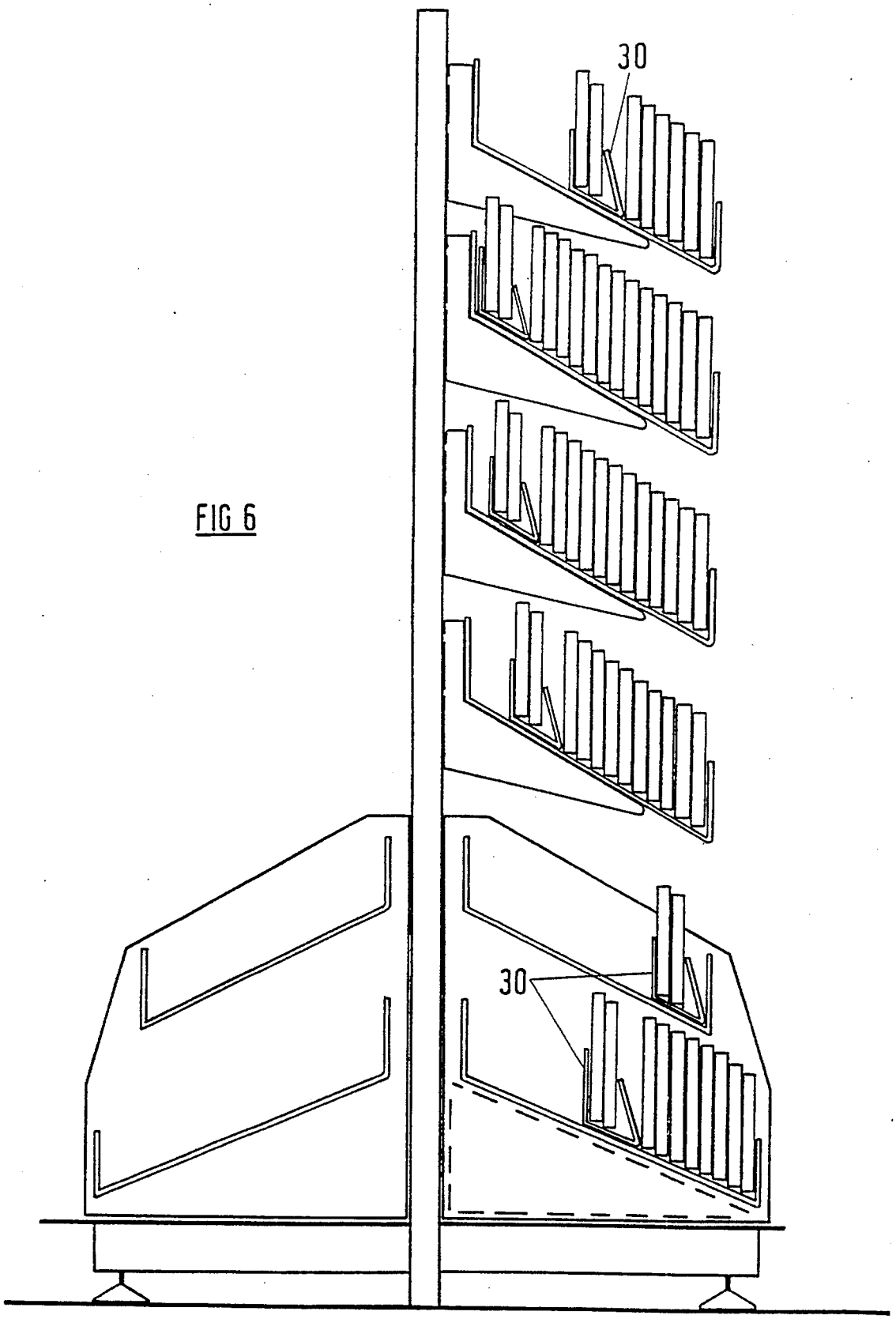
FIG. 6 is a cross-sectional view of a variety of shelves according to the invention in an acrylic shelf arrangement for the merchandising of typical flat packaged products, for example hosiery or soup packs.
Figure 7:
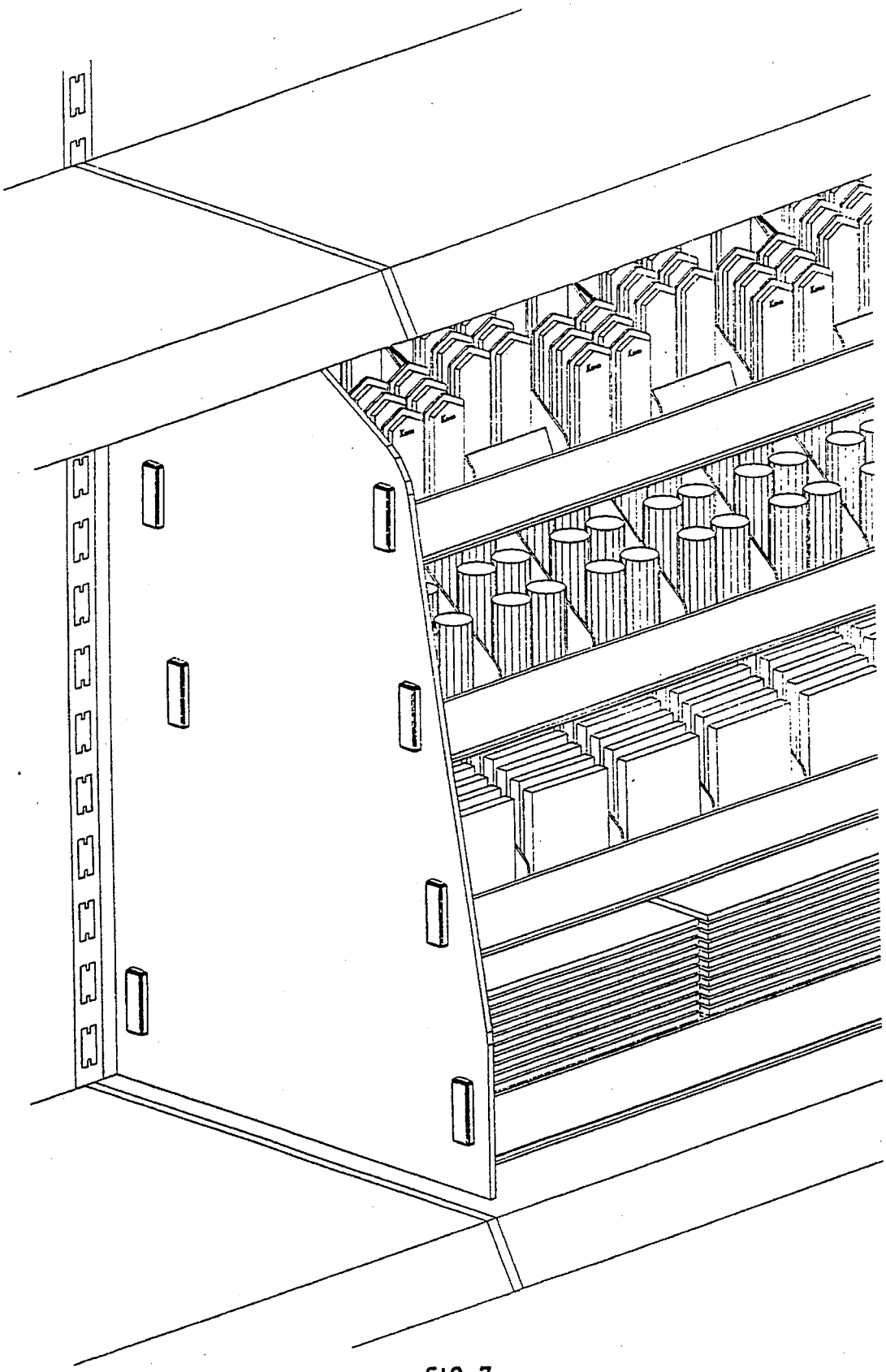
FIG. 7 is a perspective view of an apparatus with merchandise therein.

In an alternative embodiment, recessed roller balls or similar are used instead of the ribs 60 or flat base. In FIG. 6, a plurality of gravity feed apparatus according to the invention are located on a metal or timber support structure typically available in retail stores. A comparison of this figure with FIG. 1B illustrates the advantages which accrue from the invention in relation to visual presentation, space management and customer accessibility.

Figure 5:
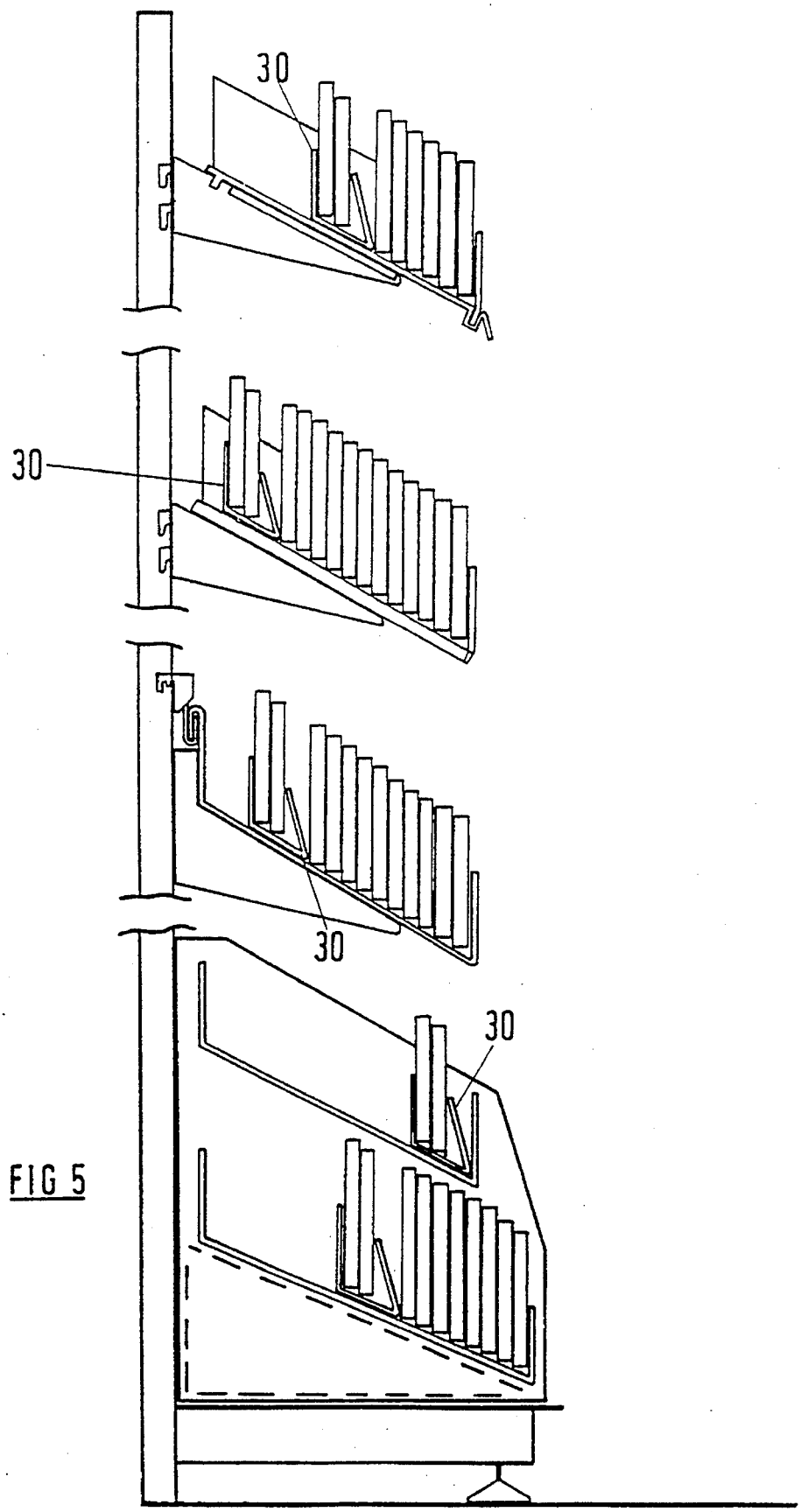
FIG. 5 is a cross-sectional through a number of examples of apparatus according to the invention.

As shown in FIG. 5, the invention can be constructed from many different materials and supported by hanging from various structures and/or manufactured s free standing units either single sided or double sided as required. The latter structures may be fitted structures or demountable structures as required.

It will be understood that the invention is not limited to the specific details described herein, which are given by way of example only and that various modifications or alterations are possible without departing from the scope of the invention as defined in the appended claims.

We claim:

1. A gravity feed merchandising apparatus comprising a sloped shelf (1) for supporting merchandise, a substantially upstanding front wall (10) and a slidable container (30) for urging or pushing the merchandise towards the front wall (10), the container (30) being adapted to contain approximately between 10% and 30% of the merchandise so as to create the force necessary to push the remaining stock of merchandise forward, characterised in that the container is fabricated or moulded in a material with a low co-efficient of friction and is provided with a generally horizontally disposed buffer (31, 42) at the lower edge of the front wall of the container for contact with merchandise adjacent the container, whereby when an item of merchandise is removed from the shelf (1), the remaining stock of merchandise is advanced towards the front wall (10) under the action of the buffer directing the force of the container (30) at the lower edges of the merchandise.

2. A gravity feed merchandising apparatus as claimed in claim 1, in which the container (30) is substantially of a U-shaped construction, with the front wall of the U being inclined rearwardly to define an edge (31) which acts as the buffer (42).

3. A gravity feed merchandising apparatus as claimed in claim 1, in which the container is substantially of a U-shaped construction having a buffer element (42) provided at the lower edge of the front wall of the U.

4. A gravity feed merchandising apparatus as claimed in any one of the preceding claims, in which the shelf (1) is sloped downwardly from its rear to the front wall (10) and has a sliding surface for the container (30).

5. A gravity feed merchandising apparatus as claimed in claim 1, in which the upstanding wall (10) at the front of the shelf is set in a vertical plane irrespective of the slope of the shelf.

6. A gravity feed merchandising apparatus as claimed in claim 1, in which the shelf (1) is divided longitudinally into a number of compartments (24) by a plurality of parallel adjustable dividers (20), with each compartment (24) being approximately the width of the respective merchandise and with each compartment (24) having a container (30) for a portion of merchandise.

7. A gravity feed merchandising apparatus as claimed in claim 6, in which the adjustable dividers (20) extend substantially the full depth of the shelf (1).

8. A gravity feed merchandising apparatus as claimed in claim 6, in which the dividers (20) are free standing 'L' shaped elements, with the horizontal arm of the 'L' providing a suitable surface for the container (30) to slide on.

9. A gravity feed merchandising apparatus as claimed in claim 6, in which the dividers (20) are substantially flat strip elements attached to the front wall (1) and/or a back wall by connectors.

* * * * *